US005303839A

United States Patent [19]

Blumenschein

[11] Patent Number: 5,303,839

[45] Date of Patent: Apr. 19, 1994

[54] PLASTIC CONTAINER WITH LID

[75] Inventor: Marcus Blumenschein, Marienheide/Müllenbach, Fed. Rep. of Germany

[73] Assignee: Jokey Plastik Wipperfürth GmbH, Wipperfürth, Fed. Rep. of Germany

[21] Appl. No.: 982,296

[22] Filed: Nov. 25, 1992

[30] Foreign Application Priority Data

Nov. 27, 1991 [DE] Fed. Rep. of Germany ..... 4138879

[51] Int. Cl.[5] ..... B65D 41/16

[52] U.S. Cl. ..... 220/306; 220/354; 220/355; 220/266; 220/270

[58] Field of Search ..... 220/355, 354, 270, 266, 220/306

[56] References Cited

U.S. PATENT DOCUMENTS

| | | | |
|---|---|---|---|
| 3,566,946 | 3/1971 | MacDonald | 220/354 X |
| 4,335,827 | 6/1982 | Knize et al. . | |
| 4,671,423 | 6/1987 | Murphy | 220/355 X |
| 4,998,622 | 3/1991 | Drack | 220/270 X |
| 5,027,969 | 7/1991 | Lesquir | 220/270 |
| 5,097,977 | 3/1992 | Straub | 220/354 X |

FOREIGN PATENT DOCUMENTS

| | | |
|---|---|---|
| 0287980 | 10/1988 | European Pat. Off. . |
| 1489515 | 10/1975 | United Kingdom . |

*Primary Examiner*—Allan N. Shoap
*Attorney, Agent, or Firm*—Browdy and Neimark

[57] ABSTRACT

The invention relates to a plastic container with lid, preferably of rectangular or oval cross-section, for holding granular, powdery, pasty or liquid materials, with sealing edge and a locating part which is provided with an intermittent snap-on edge and is borne roughly centrally by a continuous supporting edge. The invention is intended to facilitate the grasping of the lid when the container is closed, on the one hand, and the pouring of liquid or pasty materials on the other. The invention is characterized in that the top edge of the locating part (6) and the supporting edge (7) are drawn down to the level of the lower edge of the locating part (6) in the form of an arc in at least one region of major curvature of the container perimeter, in such a way that a recessed grip (13) is formed in this region which makes it possible to grasp below the retaining fold of the lid and in such a way that the lower part of the recessed grip (13) is designed as a pourer (14) consisting of the laterally lowered surfaces of the supporting edge (7) and its lower, plane section.

4 Claims, 4 Drawing Sheets

PLASTIC CONTAINER WITH LID

BACKGROUND OF THE INVENTION

1. Field of the Invention

The invention relates to a plastic container with lid, preferably of rectangular or oval planar cross-section, for holding granular, powdery, pasty or liquid materials, the wall of which has a top sealing edge for the load-bearing and sealing accommodation of a lid, the upper section of this container being provided with a locating part, said part being borne roughly at its center by a continuous supporting edge projecting in the vicinity of the sealing edge, and where the locating part is provided with an intermittent snap-on edge on the inside at the top, behind which the lid engages when put into place.

2. Prior Art

Such containers or buckets with lid are familiar in various forms. For example, the inner walls may be provided with roll-off ribs and the bottom with extension feet on the outside to allow the standardised application of printed pictures. In this way, they are designed to store the contained material safely, to prevent the undesired escape of this material and, similarly, the ingress of dust, dirt or moisture, to be mechanically stable and to allow opening without special tools and, if possible, tight re-sealing. The lid may be recessed to the level of the contents for better stackability.

Thus, for example, EP-A1-0287 980 describes a plastic bucket with associated snap-on lid where the edges of the bucket and the lid are designed in such a way that the lid seals and engages reliably. The top of the bucket wall is surrounded by a cylindrical ring with integrally moulded pockets for accommodating a carrying handle at diametrically opposite points on the perimeter of the bucket. At these points, the ring is extended downwards in an arc shape so that the lid engaged between the ring and the bucket wall can be grasped and lifted off.

In the case of rectangular containers or buckets, it is difficult or virtually impossible to grasp under the lid at the middle of the sides and lift it off. It is not practical to locate the pockets, with the ring extended downwards at this point, in the corners of the container because, on the one hand, this arrangement would be visually unappealing while, on the other hand, the carrying handle would have to be positioned diagonally.

Furthermore, the solution for paint buckets, described in EP-A1-0287 980, is unpractical because, when pouring, the paint can run between the cylindrical ring and the bucket wall with the result that re-opening of the paint bucket after previously re-closing it is made far more difficult as a result of the dried-on paint.

Another solution is known from GB-PS 14 89 515, which describes a plastic container with lid of circular cross-section for holding granular, powdery, pasty or liquid materials. The wall of this container has a top sealing edge for the load-bearing and sealing accommodation of a lid, and its upper section is provided with a locating part, surrounding the sealing edge at intervals. The locating part is borne by a continuous supporting edge projecting in the vicinity of the sealing edge. The fact that the top edge of the locating part and the supporting edge are extended downwards in the form of an arc to the level of the lower edge of the locating part creates a kind of recessed grip in this area which makes it possible to grasp below the retaining fold on the lid.

However, this solution does not eliminate the disadvantages described; specifically, it does not prevent the lid sticking to the container after pouring out the contents.

OBJECTIVES AND SUMMARY OF THE INVENTION

The invention is based on the task of designing a container with lid, of the kind mentioned at the beginning, in such a way that the lid can be more easily gripped and removed without special tools when the container is closed, and in which the pouring of liquid and pasty materials, in particular, is facilitated and the penetration of these materials into the space between the locating part and the container wall is prevented.

According to the invention, the task is solved by the top edge of the locating part and the supporting edge being extended downwards to the level of the lower edge of the locating part in the form of an arc in at least one region of major curvature of the container perimeter, in such a way that a recessed grip is formed in this region which makes it possible to grasp below the retaining ring of the lid and in such a way that the lower part of the recessed grip is designed as a pourer consisting of the laterally lowered surfaces of the supporting edge and its lower, plane section.

If a container of this kind is to be opened and partially or completely emptied, the lid can be grasped particularly easily in the recessed grip and lifted off. The fact that the recessed grip is simultaneously designed as a pourer also considerably facilitates the emptying of the container while at the same time preventing paint, for example, from running between the locating part and the wall of the container. This prevents the lid from sticking after the container has been only partially emptied and subsequently reclosed.

In a further development of the invention, the recessed grip is located in one corner of the container. If the invention is to be used on a rectangular container, the carrying handle can be secured at the centre of the sides of the bucket in the customary manner, regardless of the arrangement of the recessed grip.

In an improvement of the invention, there is also provision for the recessed grip to be covered by a tear-off strip which is connected to the extended part of the supporting edge by several webs designed with predetermined breaking points.

This strip is easily applied during manufacture of the container and allows the container to be filled and closed for the first time. However, the container cannot be opened until the strip has been removed, this making it easy to detect unauthorised opening.

BRIEF DESCRIPTION OF THE PREFERRED EMBODIMENT

The invention is described in more detail below on the basis of the drawing in practical examples. The diagrams show the following:

FIG. 1 A partially cut-away side view of a container according to the invention, with lid in place FIG. 2 A top view of the container FIG. 3 An enlarged section along line III—III in FIG. 2

FIG. 4 An enlarged section along line IV—IV in FIG. 2

FIG. 5 A detailed representation of the recessed grip

FIG. 6 A detailed representation of the recessed grip with strip in front

DETAILED DESCRIPTION OF THE PREFERRED EMBODIMENT

Figure 1:
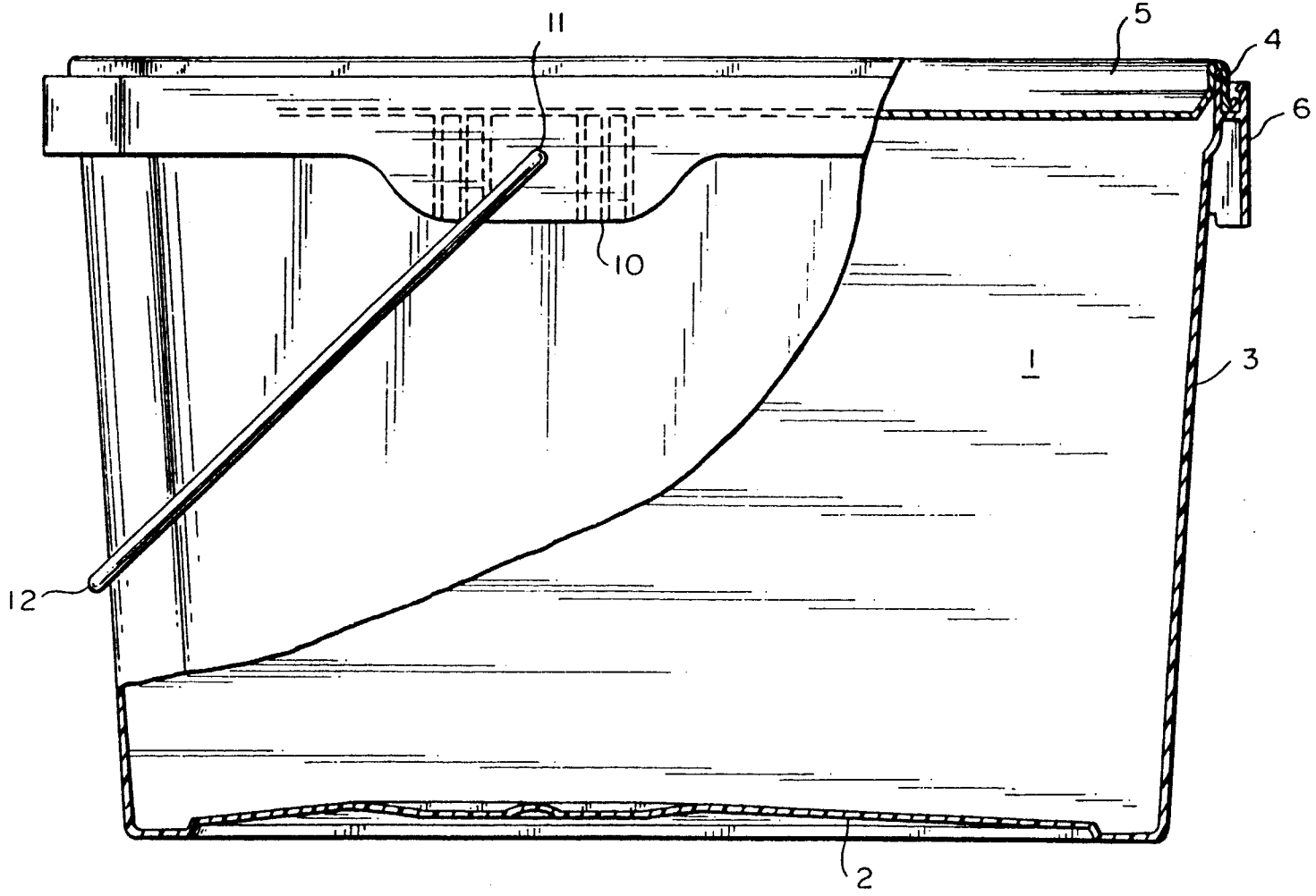
Figure 2:
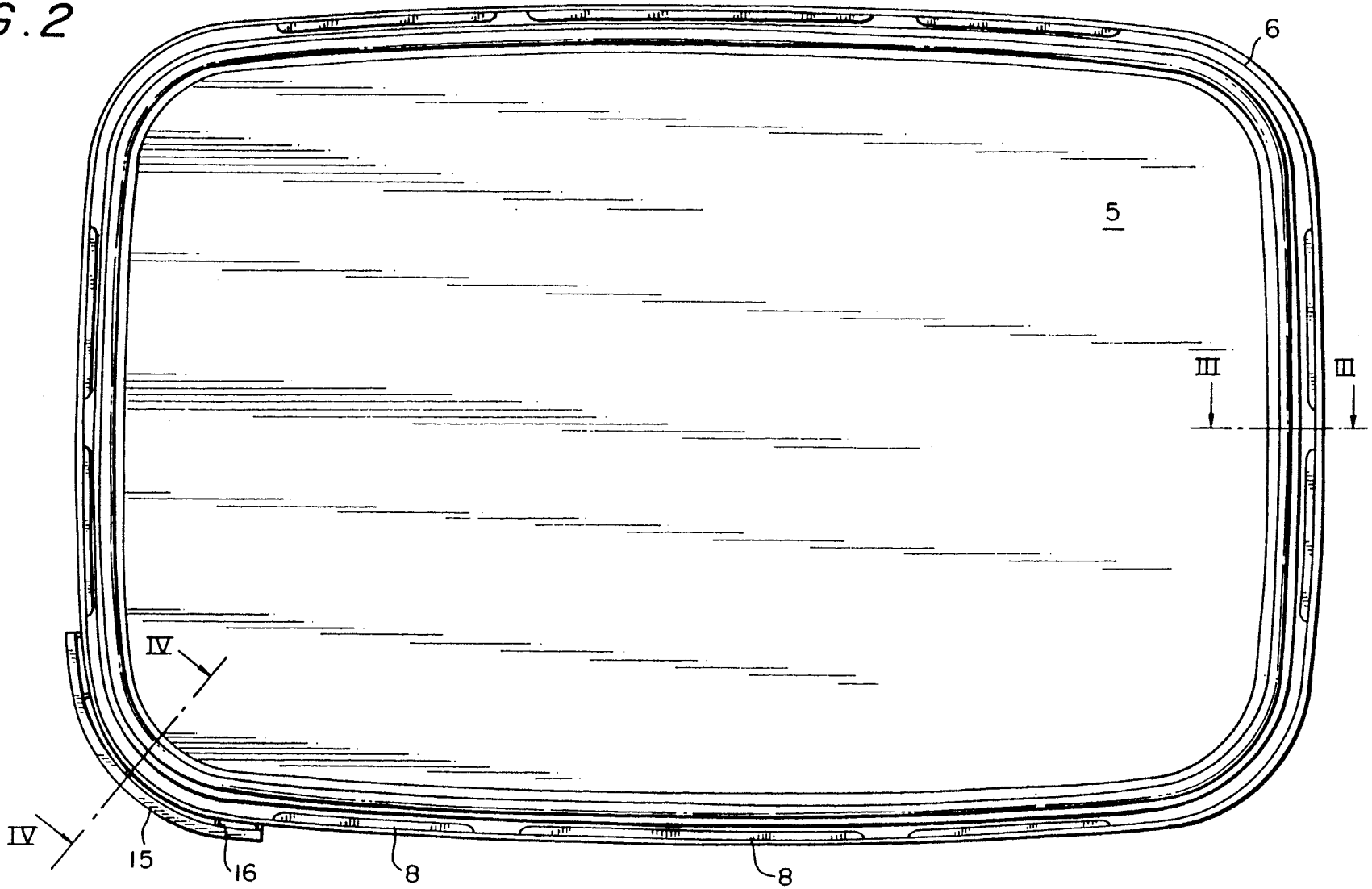
Figure 3:
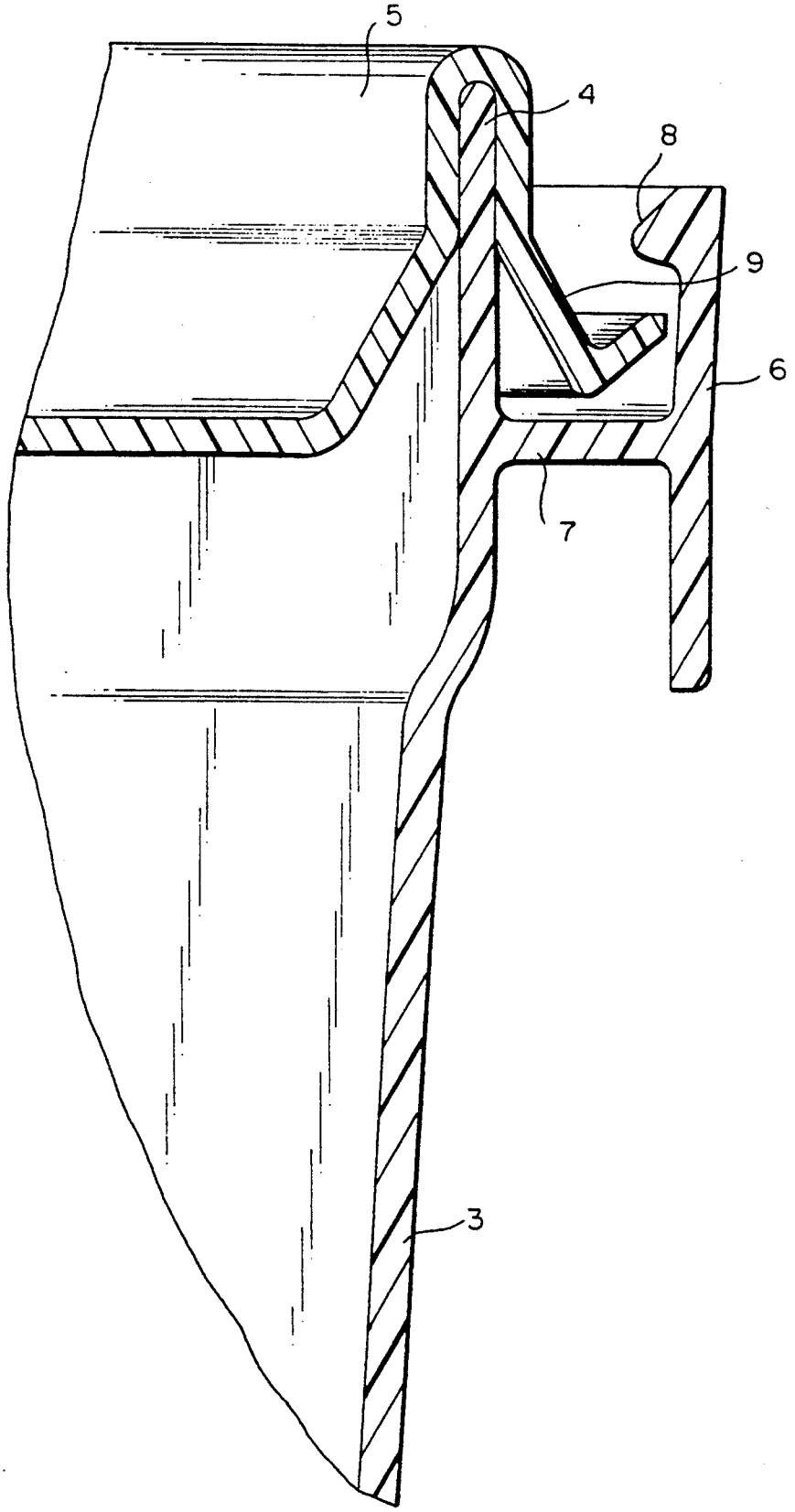

As can be seen from FIGS. 1 and 2, container 1 consists of a bottom 2 with rising wall 3, at the end of which there is a sealing edge 4 to accommodate a lid 5. According to FIG. 2, container 1 has an essentially rectangular planar cross-section. On the outside of container 1, sealing edge 4 is surrounded by a locating part 6, arranged at a distance from edge 4. Locating part 6 is borne roughly at its centre by an all-round supporting edge or flange 7 having a top surface 17 and bottom surface which projects from wall 3 in the vicinity of sealing edge 4. At the top end of locating part 6, on the side facing, the wall, is an integrally moulded snap-on edge 8, below which retaining fold 9 of lid 5 engages when put into place. As shown in FIG 2, snap-on edges 8 surround the container intermittently or at intervals. At the same time, retaining fold 9 also surrounds sealing edge 4 of container 1. (FIG. 3)

As can be seen from FIG. 1, the lower edge of locating part 6 is extended downwards in the form of an arc in the middle of two opposite side surfaces of wall 1, forming a tab 10. Tab 10 has a hole 11 to accommodate the bent end of a carrying handle 12.

Figure 5:
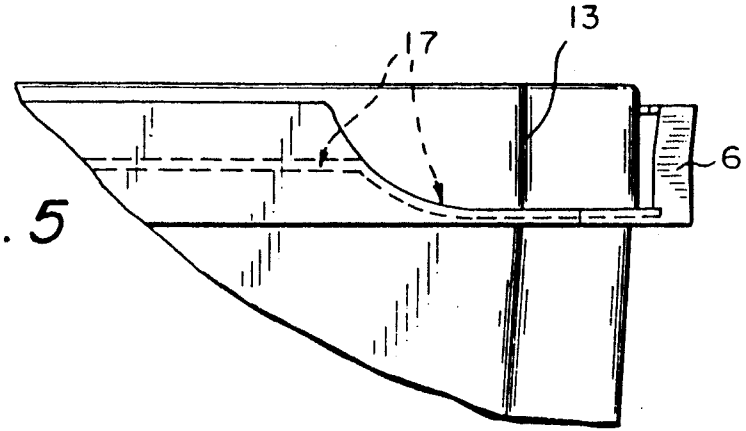
Figure 6:
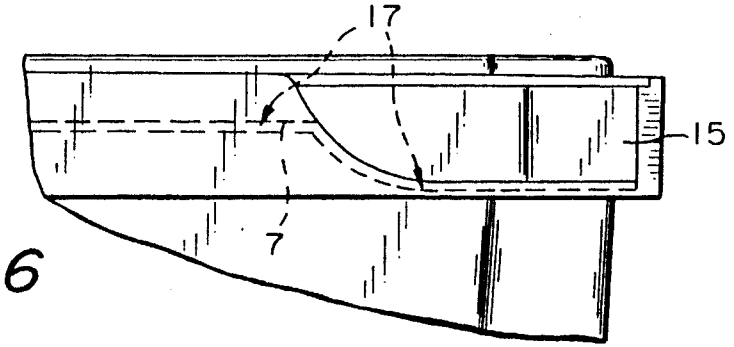
Figure 4:
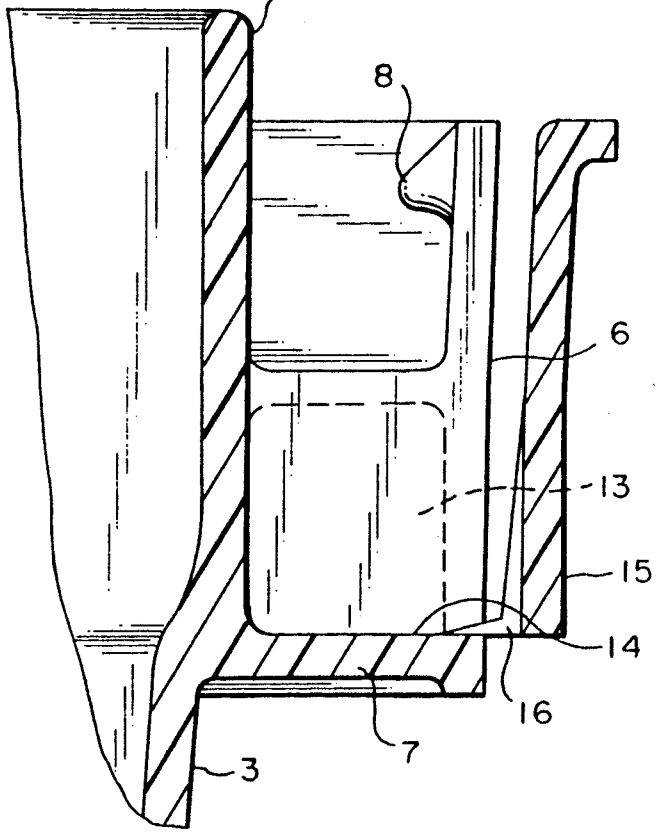

As can be seen from FIGS. 4 to 6, a recessed grip 13 for opening lid 5 is integrated into one corner of container 1 in such a way that both the, top edge of locating part 6 and supporting edge 7 are drawn downwards to the level of the lower edge of locating part 6. As a result, retaining fold 9 becomes freely visible in this area and is easy to grasp underneath for the purpose of lifting off lid 5.

The lateral surfaces of the lowered supporting edge 7 and the lower, plane section thereof together form a pourer 14. This pourer 14 allows convenient emptying of container 1 without, for example, paint running between locating part 6 and the outer wall of container 1. This makes it possible for container 1 to be partially emptied and reclosed without retaining fold 9 being stuck in the U-shaped part formed by locating part 6, supporting edge 7 and the outer wall of container 1.

A tear-off strip 15 is located in front of recessed grip 13 in order to prevent or subsequently detect unauthorised opening of container 1. This strip 15 is connected to the drawn-down part of supporting edge 7 by way of several webs 16 designed as predetermined breaking points. (FIGS. 4, 6) As a result, the all-round locating part 6 appears to be closed in this area, thus making it clearly visible that container 1 has not yet been opened.

When tearing off strip 15 by snapping off and, if necessary, bending back and forth several times, recessed grip 13 is exposed and the lid can be lifted off, as already described.

As recessed grip 13 can be located independently of tab 10, the lid can be opened particularly easily if recessed grip 13 is located in one corner of the container. The invention can be used for containers having round, rectangular or oval without further modification. In the case of oval containers, where carrying handle 12 is customarily attached at diametrically opposite points in the region of maximum curvature of the container wall, both the tabs 10 required for attaching the handle and also the recessed grips 13 can be located at the same point. It is equally possible to locate recessed grip 13 between the opposite tabs 10.

List of reference numbers

1 Container
2 Bottom
3 Wall
4 Sealing edge
5 Lid
6 Locating part
7 Supporting edge
8 Snap-on edge
9 Retaining fold
10 Tab
11 Hole
12 Carrying handle
13 Recessed grip
14 Pourer
15 Strip
16 Web

I claim:

1. A plastic container with a lid for holding granular, powdery, pasty or liquid materials, said container comprising;

at least one wall (3) having a top sealing edge (4);

an upper section of said at least one wall having a locating part (6);

a supporting flange (7) connecting said wall (3) adjacent to said sealing edge (4) to approximately a center of said locating part (6);

said supporting flange having a top surface, an intermittent snap-on edge (8) on an inside of a top edge of said locating part (6);

said lid sealingly mountable below said snap-on edge on said sealing edge (4), said top edge of said locating part (6) and said supporting flange (7) having an arced down region, said arced down region of said top edge of said locating part (6) and said supporting flange (7) being formed when said top edge of said locating part and said top surface of said supporting flange coincide at a level substantially equal to a lower edge of said locating part (6);

wherein, said arced down region creates a recess and pourer which respectively allows grasping below a retaining fold (9) of said lid in place on said sealing edge and pouring of said materials from said container or located between said wall (3) and said locating part (6).

2. The container according to claim 1, wherein, said container has a rectangular planar cross-section, and said recess and pourer are located in one corner of said container.

3. The container according to claim 1, wherein, said recess and pourer are covered by a tear-off strip (15) connected to said arced down region by several webs (16) having predetermined breaking points.

4. The container according to claim 1, wherein said container has an oval planar cross-section and said recess and pourer are located at a point of greatest curvature on a perimeter of said container.

* * * * *